United States Patent [19]

Nilssen

[11] Patent Number: 4,651,059

[45] Date of Patent: Mar. 17, 1987

[54] HIGH-FREQUENCY POWER-LIMITED LIGHTING SYSTEM

[76] Inventor: Ole K. Nilssen, Caeser Dr. R.R.-5, Barrington, Ill. 60010

[21] Appl. No.: 569,188

[22] Filed: Jan. 9, 1984

[51] Int. Cl.[4] ..... H05B 35/00; H05B 37/00; H05B 39/00; H05B 41/00

[52] U.S. Cl. ..... 315/182; 315/DIG. 5; 315/DIG. 7; 315/354; 315/277; 361/35; 362/225

[58] Field of Search ..... 361/35, 36; 362/225; 315/DIG. 5, DIG. 7, 182, 184, 354, 276, 277

[56] References Cited

U.S. PATENT DOCUMENTS

| | | | |
|---|---|---|---|
| 3,727,104 | 4/1973 | Neal et al. | 361/35 |
| 3,971,967 | 7/1976 | Hawkins | 315/DIG. 5 |
| 3,987,339 | 10/1976 | Wroblewski | 315/282 |
| 4,207,497 | 6/1980 | Capewell et al. | 315/244 |
| 4,213,076 | 7/1980 | Walz | 315/DIG. 5 |
| 4,339,695 | 7/1982 | Siglock | 361/35 |
| 4,388,562 | 6/1983 | Josephson | 315/DIG. 5 |
| 4,441,056 | 4/1984 | Siglock | 361/35 |
| 4,504,891 | 3/1985 | Mazis | 362/225 |

*Primary Examiner*—Saxfield Chatmon

[57] ABSTRACT

A lighting system for a suspended ceiling comprises a central high-frequency power source feeding a plurality of power conditioning units permanently wired-in and mounted in various locations on the permanent ceiling above the suspended ceiling. Each such power conditioning unit provides a power-limited Class-3 high-frequency voltage at an output receptacle and is operable to power a special fluorescent lighting fixture by way of a light-weight flexible two-wire detachable connect cord. Special fluorescent lighting fixtures are mounted in the suspended ceiling, with each such lighting fixture being powered from a power conditioning unit mounted somewhere nearby on the permanent ceiling above. Due to the Class-3 power-limited nature of the output of each of the power conditioning units, as combined with the detachable light-weight and flexible nature of the connect cords, each individual lighting fixture may be treated as a plug-in portable lighting product; which implies a particularly high degree of flexibility in installation and use. As a consequence of the high-frequency operation, the size and weight of the impedance matching means required in the special lighting fixture (to provide proper operation of the fluorescent lamp means therein) is very modest, which results in a particularly compact and light-of-weight lighting fixture.

20 Claims, 2 Drawing Figures

HIGH-FREQUENCY POWER-LIMITED LIGHTING SYSTEM

BACKGROUND OF THE INVENTION

1. Field of Invention

The present invention relates to a lighting system wherein the power to each of a plurality of lighting fixtures is provided in the form of a power-limited high-frequency voltage by way of a plug-in flexible light-weight cord from a remotely located permanently installed Class-3 power supply.

2. Description of Prior Art

Lighting systems for general purpose lighting normally consists of permanently wired-in lighting fixtures, with each lighting fixture obtaining its power directly from the regular power line. Since the amount of power available from such a regular power line is large enough to be considered dangerous from a fire-initiation viewpoint, it is required by the National Electrical Code that electrical conductors and other products connected directly with such a power line be made and/or installed in very special ways. For instance, electrical conductors typically have to be installed in the form of armored cable or within steel conduits.

As a result of the need for such protective measures, the powering of lighting fixtures directly from the power line must be done by relatively costly and inflexible means—with the net effective result that these lighting fixtures, once installed, become non-movable entities. Such non-movability, especially in connection with suspended ceiling systems, is a great limitation on the utility of the overall lighting system.

SUMMARY OF THE INVENTION

Objects of the Invention

A first object of the present invention is that of providing an improved and easy-to-install lighting system for general lighting purposes.

A second object is that of providing a lighting system comprising a plurality of lighting fixtures, and wherein each of these lighting fixtures can be installed and/or moved with particular ease and flexibility.

A third object is that of providing a fluorescent lighting system wherein each lighting fixture is powered by way of a light-weight, flexible and detachable connect cord from a power-limited high-frequency voltage provided by a permanently installed power conditioning unit.

These as well as other objects, features and advantages of the present invention will become apparent from the following description and claims.

BRIEF DESCRIPTION

In the preferred embodiment, which relates to a suspended ceiling system, subject lighting system consists of a central frequency converter connected with an ordinary electric utility power line and adapted to provide a relatively high-frequency (30 kHz) non-power-limited output voltage. This non-power-limited high-frequency output voltage is applied by way of permanently installed wiring means to a plurality of power conditioning units, the output of each of which is power-limited to a maximum of 100 Volt-Ampere in accordance with specifications for Class-3 circuits (as defined by the National Electrical Code) and applied by way of a plug-in light-weight flexible two-wire electric connect cord to a special fluorescent lighting fixture mounted in the grid of the suspended ceiling system.

Each of the power conditioning units is installed on the permanent ceiling in a location above an area in the suspended ceiling where a lighting fixture is apt to be needed.

The power-limited high-frequency voltage output from each power conditioning unit is available from a two-terminal female receptacle means capable of receiving a two-prong male plug means.

Each special fluorescent lighting fixture has a high-frequency voltage input receptacle in the form of a recessed two-prong male plug means capable of receiving a two-terminal female receptacle means.

Thus, by way of the light-weight flexible two-wire connect cord, which has a two-prong male plug means at its one end and a two-terminal femal receptacle means at its other end, a special lighting fixture installed in the suspended ceiling can be connected with and powered from a power conditioning unit mounted on the permanent ceiling somewhere in the area above that lighting fixture's location in the suspended ceiling.

Due to the Class-3 nature of the output of each of the power conditioning units, as combined with the detachable and flexible nature of the connect cords, each individual special lighting fixture may be treated as a plug-in portable lighting product.

In other words, in approximate net effect, subject system consists of non-permanently-mounted lighting fixtures whose ballasting means have been removed, modified and permanently mounted externally of the fixtures and disconnectably connected with the fixtures by way of flexible two-wire connect cords.

DESCRIPTION OF THE PREFERRED EMBODIMENT

Description of the Drawings

Figure 1:
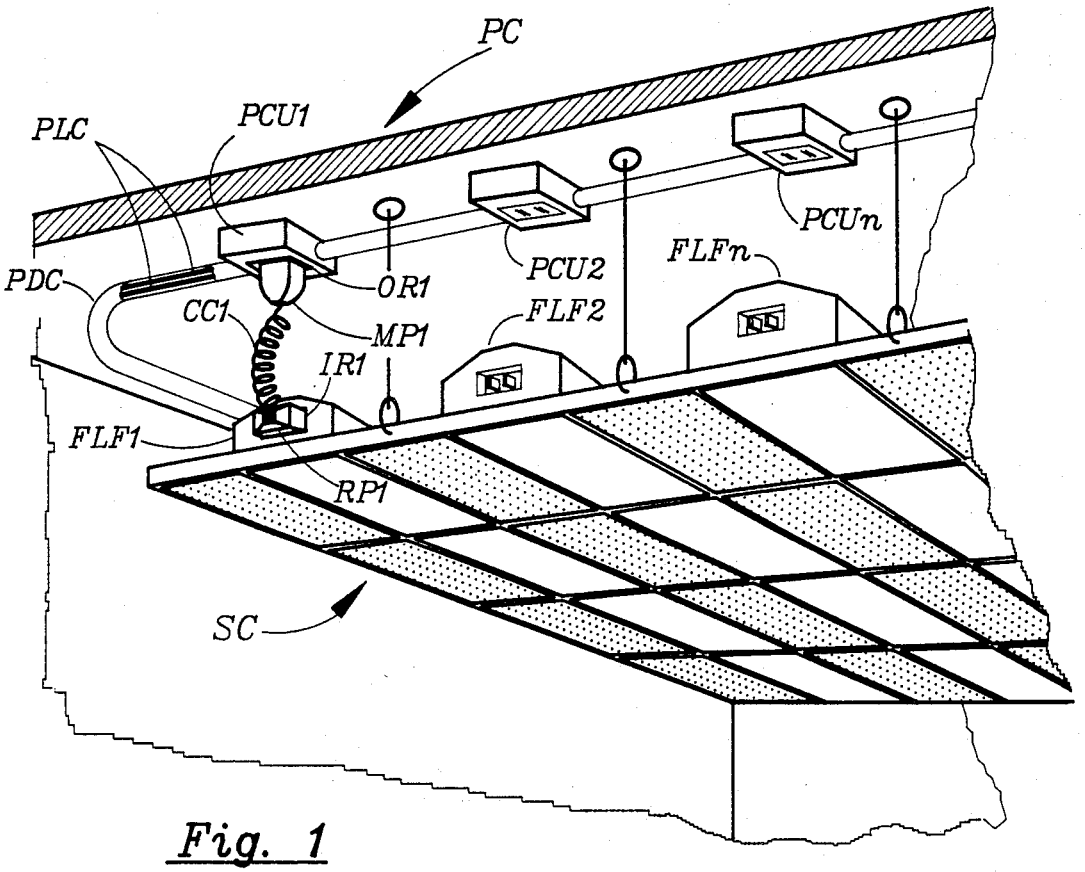
FIG. 1 illustrates from a systems viewpoint the preferred embodiment of the overall high-frequency power-limited lighting system of the present invention.

In FIG. 1, a central high-frequency power supply PS is mounted on the permanent ceiling PC above suspended ceiling SC. Power to power supply PS is provided in the form of ordinary non-power-limited 120 Volt/60 Hz voltage from a pair of power line conductors PLC within an input conduit IC.

Non-power-limited high-frequency (30 kHz) output voltage from power supply PS is provided by way of high-frequency conductors HFC in output conduit OC to a number of power conditioning units PCU1, PCU-2–PCUn. Output conduit OC as well as the power conditioning units are non-detachably mounted on the permanent ceiling.

Each power conditioning unit has a power output receptacle, such as OR1 of power conditioning unit PCU1. Plugged into OR1 is a two-prong male plug MP1 mounted at one end of light-weight flexible two-wire connect cord CC1.

Non-permanently mounted in the suspended ceiling is a plurality of fluorescent lighting fixtures FLF1, FLF2–FLFn; each of which has an input receptacle such as IR1 on FLF1. Plugged into IR1 is a two-terminal female receptacle plug RP1, which is mounted at the other end of connect cord CC1.

Each of the fluorescent lighting fixtures is connected with a power conditioning unit by way of a connect cord such as CC1.

Figure 2:
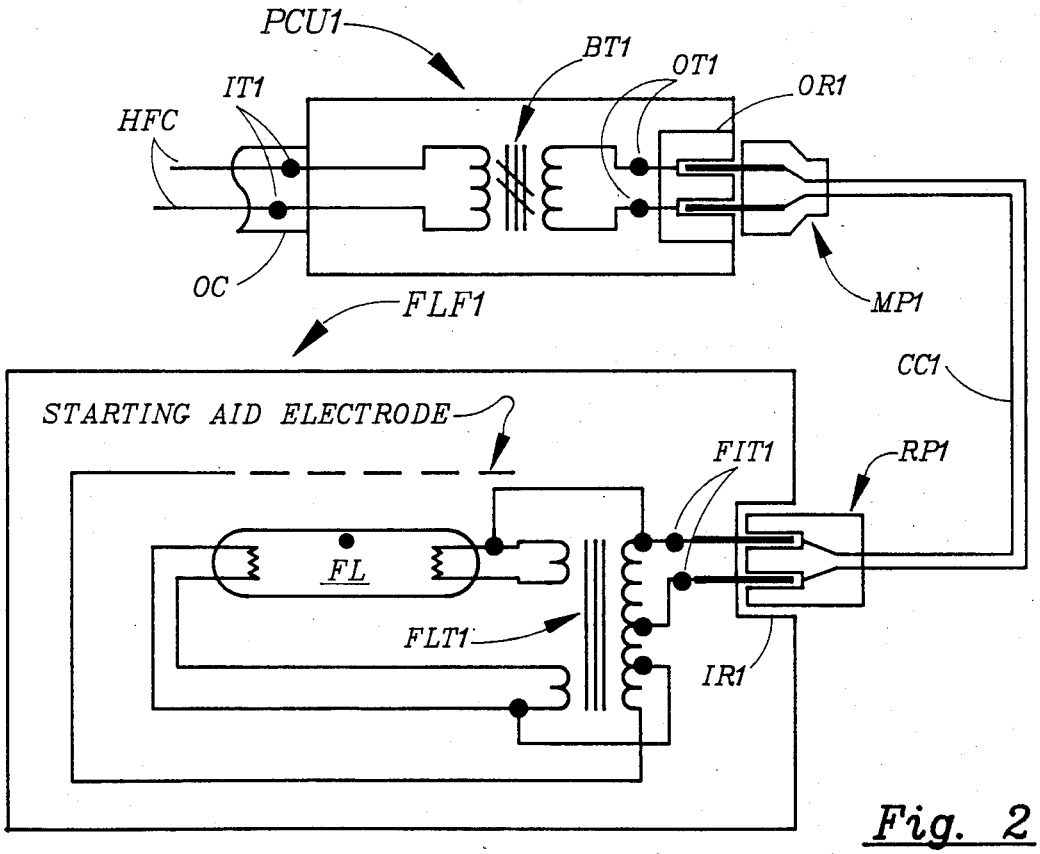
FIG. 2 shows electrical circuit details of a power conditioning unit as coupled with a special fluorescent lighting fixture.

FIG. 2 illustrates electrical details of power conditioning unit PCU1 and fluorescent lighting fixture FLF1—showing the non-power-limited 30 kHz voltage from conductors HFC connected with input terminals IT1 of PCU1. A current-limiting high-frequency ballasting transformer BT1 is connected in circuit between input terminals IT1 and output terminals OT1 of PCU1.

The power-limited high-frequency voltage provided at output terminals OT1 is applied by two-wire connect cord CC1 to input terminals FIT1 of lighting fixture FLF1, which fixture includes a fluorescent lamp FL connected with input terminals FIT1 by way of high-frequency fluorescent lamp transformer FLT1.

Description of Operation

With reference to FIGS. 1 and 2, the operation of subject lighting system may be explained as follows.

In FIG. 1, central power supply PS—which is a power-line-operated inverter of conventional design—provides a non-power-limited 30 kHz voltage output that is applied to the high-frequency conductors HFC in output conduit OC. Thus, this non-power-limited high-frequency voltage is distributed to a plurality of power conditioning units—such as PCU1 of FIG. 2—which are permanently wired-in and mounted on the permanent ceiling PC.

Each power conditioning unit, by way of its current-limiting ballasting transformer (such as BT1), transforms the non-power-limited 30 kHz voltage received from the central power supply to an output of power-limited 100 Volt/30 kHz voltage; which output is then applied to the power conditioning unit's output receptacle (such as OR1 in PCU1).

By way of disconnectable flexible cord means (such as CC1), each of the plurality of fluorescent lighting fixtures (such as FLF1) is connected with a power conditioning unit (such as PCU1), and is thereby provided with an input of power-limited 100 Volt/30 kHz voltage. This voltage is then, within each lighting fixture, applied to a fluorescent lamp transformer (such as FLT1), which transforms the 100 Volt/30 kHz input voltage to a voltage level appropriate for starting and operating the fluorescent lamp. Also, this fluorescent lamp transformer provides auxiliary outputs for low-voltage heating of the fluorescent lamp cathodes as well as for lamp starting aid.

To be acceptable in Class-3 applications, each of the plurality of power conditioning units has output characteristics conforming to the specifications provided for Class-3 circuits in Part C of Article 725 of the 1984 National Electrical Code.

Because of the Class-3 characteristics of the power conditioning units, the amount of power available from each of their output receptacles (such as OR1 on PCU1) is limited to a level considered acceptably safe from a fire initiation viewpoint. Yet, that amount of power—which may be as high as 100 Watt—is quite adequate to provide for ample light output from a fluorescent lighting fixture.

Due to the high-frequency operation, the fluorescent lamp transformer within each fixture (such as FLT1 in FLF1) can be extremely small and light-of-weight; which, especially when combined with the reduced fixture/structural requirements due to the Class-3 characteristics, permits and fluorescent lighting fixtures to be particularly compact and light-of-weight.

Thus, because of their Class-3 nature, the fixtures in subject lighting system may be considered as ordinary portable (plug-in) lighting products; which implies that they may be installed, moved, removed, and/or exchanged by unskilled persons.

And, because of their light weight, they are particularly easy to handle.

Concluding Comments

First, it is noted that Class-2 operation (as defined in Article 725 of the 1984 National Electrical Code) may be employed as a near-equivalent alternative to Class-3 operation.

Second, it is noted that subject power conditioning units may be part of and/or comprised within substantially ordinary junction boxes.

Third, except for Class-2 operation, it is noted that there is no basic need for the ballasting transformers in the power conditioning units to have isolated secondary windings.

Fourth, it is noted that the efficient distribution of high-frequency (30 kHz) power requires special considerations, such as—for instances—the use of litz wire.

Fifth, it is noted that subject power-limited lighting system is not limited to be used with fluorescent lighting fixtures. Rather, it may just as well be used with H.I.D. and/or incandescent lighting fixtures.

Sixth, it is noted that, while two-wire connection between the power conditioning units and the fluorescent lighting fixtures is advantageous as compared with multi-wire connection, it is definitely not a requirement for achieving the power-limited Class-3 status.

Seventh, it is noted that the term "lighting fixture" as used herein does not necessarily refer to a permanently installed (or fixtured) lighting product, but rather refers more generally to a lighting means capable of housing and/or holding one or more incandescent, fluorescent and/or H.I.D. lamps and suitable for general lighting applications; which lighting means—were it not for the Class-3 provisions—would normally have to be fixtured.

Eighth, the 1984 National Electrical Code is published by NATIONAL FIRE PROTECTION ASSOCIATION, BATTERY PARK, QUINCY, MASS. 02269.

Ninth, the 1984 National Electrical Code, and especially Article 725 thereof, is herewith, by reference, made part of this specification.

It is believed that the present invention and its several attendant advantages and features will be understood from the preceeding description. However, without departing from the spirit of the invention, changes may be made in its form and in the construction and interrelationships of its component parts, the form herein described merely representing the presently preferred embodiment.

What is claimed is:

1. A lighting system comprising:

frequency conversion and distribution means connected with an ordinary electric utility power line and adapted to generate and distribute a substantially non-current-limited relatively high frequency voltage to a set of non-power-limited terminals at each of a plurality of different locations, whereby each set of non-power-limited terminals is provided with said non-current-limited voltage;

a plurality of power conditioning units, each power conditioning unit: (a) being electrically connected with the set of non-power-limited terminals at one of said locations, (b) having current-limiting means operative to transform the substantially non-current-limited voltage received therefrom into a manifestly current-limited output voltage, and (c) having a pair of output terminals across which said current-limited output voltage is provided; and a plurality of lighting fixtures, each such lighting fixture: (a) having a pair of input terminals, (b) having lamp means, (c) having connect and matching means operative to connect between the input terminals and the lamp means, and to match electric power provided at the input terminals to the electrical requirements of the lamp means, (d) being adapted, by way of said input terminals, to be powered from a manifestly current-limited relatively high frequency voltage such as said output voltage, and (e) being disconnectably connected, by way of said input terminals, with the output terminals of one of said power conditioning units;

whereby each lighting fixture is disconnectably connectable with the output terminals of one of said power conditioner units and operable to be properly powered by the current-limited output voltage provided therefrom.

2. The lighting system of claim 1 wherein the maximum power output available from said non-power-limited terminals is of a magnitude that is regarded by an authoritative entity, such as the NATIONAL FIRE PROTECTION ASSOCIATION, as being potentially unsafe from a fire initiation viewpoint, while the maximum power output available from the output terminals of each of said power conditioning units is limited to a magnitude that is regarded by said authoritative entity as being acceptably safe from a fire- initiation viewpoint.

3. The lighting system of claim 1 wherein the maximum power output available from said non-power-limited terminals is substantially higher than 250 Volt-Ampere, while the maximum power output available from the output terminals of each of said power conditioning units is on the order of 250 Volt-Ampere or less.

4. The lighting system of claim 1 wherein the electrical output characteristics of each of said power conditioning units conform to the specifications for Class-3 circuits as defined in Article 725 of the 1984 National Electrical Code.

5. The lighting system of claim 1 and a plurality of flexible electrical cord means, each such cord means being operable to provide connection between the output terminals of one of said power conditioning units and the input terminals of one of said lighting fixtures, thereby permitting each fixture to be installed and operated at a location remote from the power conditioning unit from which it receives its power.

6. The lighting system of claim 5 adapted for use with a suspended ceiling that is located underneath and suspended from a permanent ceiling, wherein said power conditioning units are permanently mounted onto said permanent ceiling and wherein said lighting fixtures are non-permanently mounted in said suspended ceiling.

7. The lighting system of claim 1 wherein at least one of said lighting fixtures comprises a fluorescent lamp.

8. The lighting system of claim 7 wherein said fluorescent lamp is ballasted by one of said power conditioning units.

9. The lighting system of claim 7 wherein an electrical cord means requires no more than two electrical conductors for proper operation of said fluorescent lamp.

10. A fluorescent lighting system for a suspended ceiling, said suspended ceiling having a grid-structure and being suspended some distance underneath a permanent ceiling, said lighting system comprising:

frequency converter means connected with an ordinary electric utility power line and operable to provide a substantially non-current-limited relatively high frequency primary voltage at a set of primary output terminals;

distribution means connected with said set of primary output terminals and operable to distribute said primary voltage to each of a number of pairs of secondary output terminals positioned at different locations on said permanent ceiling, each of said pairs of secondary output terminals providing a substantially non-current-limited relatively high frequency secondary voltage;

a number of power conditioning units, each power conditioning unit: (a) being permanently mounted at one of said locations, (b) being electrically connected with a pair of secondary output terminals at that location, (c) having currentlimiting means operative to transform the substantially non-current-limited relatively high frequency secondary voltage received therefrom into a manifestly current-limited relatively high frequency tertiary voltage, and (d) having a pair of tertiary output terminals across which said current-limited tertiary voltage is provided; and a number of fluorescent lighting fixtures, each lighting fixture: (a) being non-permanently mounted in the grid-structure of the suspended ceiling, (b) having a pair of input terminals, (c) having lamps means, (d) having connect and matching means operative to connect between the input terminals and the lamp means, and to match electric power provided at the input terminals to the electrical requirements of the lamp means, (e) being adapted to be properly operated from a voltage such as said manifestly current-limited relatively high frequency tertiary voltage, and (f) being disconnectably connected with the tertiary output terminals of one of said power conditioning units by way of a flexible electrical cord means;

whereby each lighting fixture is disconnectably connectable with the output terminals of one of said power conditioner units and operable to be properly powered by the current-limited voltage provided therefrom.

11. The lighting system of claim 10 wherein the rate of energy output potentially available directly from one of said pairs of secondary output terminals is considered by an authritative entity, such as the NATIONAL FIRE PROTECTION ASSOCIATION, as being non-safe from a fire initiation viewpoint, whereas the rate of energy output potentially available from a pair of said tertiary output terminals is considered by said authoritative entity as being reasonably safe from a fire initiation viewpoint.

12. The lighting system of claim 10 wherein at least one of said fluorescent lighting fixtures comprises a replaceable fluorescent lamp.

13. The lighting system of claim 10 wherein at least one of said fluorescent lighting fixtures comprises a fluorescent lamp requiring for its proper operation a manifest currentlimiting function, and wherein said manifest current-limiting function is provided by the power conditioning unit to which this one fluorescent lighting fixture is connected.

14. A lighting system adapted to be powered from the power-line voltage on an ordinary electric utility power line and comprising:

frequency conversion means connected with said power line and operable to provide an output of substantially non-current-limited relatively high frequency primary voltage;

distribution means connected with said primary voltage and operable to provide a substantially non-current-limited relatively high frequency secondary voltage across a pair of secondary output terminals at each of a number of different locations;

a number of power-limiting means, each connected with a pair of secondary output terminals and each providing across a pair of tertiary output terminals a voltage that is: (a) manifestly current-limited such that the maximum Volt-Ampere product extractable from said pair of tertiary output terminals is limited to a magnitude that is considered by an authoritative entity, such as the NATIONAL FIRE PROTECTION ASSOCIATION, as being reasonably safe from fire-initiation hazard; and a number of lighting fixtures, each lighting fixture: (a) having a pair of input terminals, (b) having lamp means, (c) having connect and matching means operative to connect between the input terminals and the lamp means, and to match electric power provided at the input terminals to the electrical requirements of the lamp means, (d) being adapted to be properly operated from the voltage available from said pair of tertiary output terminals, and f) being connectable with said pair of tertiary output terminals by way of a disconnectable two-conductor electrical cord means;

whereby each lighting fixture is disconnectably connectable with the tertiary output terminals of one of said power-limiting means and operable to be properly powered by the current-limited voltage provided therefrom.

15. The lighting system of claim 14 wherein the magnitude of the power available from said pair of power-line terminals is considered by said authoritative body as being potentially unsafe from a fire initiation viewpoint.

16. A lighting system adapted to be powered from the relatively low frequency voltage on an ordinary electric utility power line, said system comprising:

frequency conversion means connected with said power line and operable to provide a substantially non-current-limited relatively high frequency output voltage at a set of distribution conductors;

a plurality of lighting fixtures non-permanently mounted at different locations at or near a mounting surface, each lighting fixture: (a) having a set of input terminals, (b) having lamp means, (c) having connect and matching means operative to connect between the input terminals and the lamp means, and to match electric power provided at the input terminals to the electrical requirements of the lamp means, and (d) requiring for proper operation that a relatively high frequency voltage be provided at its input terminals; and for each lighting fixture:

(i) power conditioning means that is non-disconnectably connected with said distribution conductors and mounted at or near said mounting surface in a location within a relatively short distance from the lighting fixture, said power conditioning means being operable to provide at a set of output terminals the relatively high frequency voltage required by said lighting fixture, and (ii) flexible cord means operable to provide disconnectable electrical connection between the input terminals of said lighting fixture and the output terminals of said power conditioning means;

whereby each lighting fixture is disconnectably connectable with the output terminals of one of the power conditioning means and operable to be properly powered by the high frequency voltage provided therefrom.

17. The lighting system of claim 16 wherein the maximum power output available from said set of distribution conductors is of a magnitude that is regarded by an authoritative entity, such as the NATIONAL FIRE PROTECTION ASSOCIATION, as being potentially hazardous from a fire initiation viewpoint, while the maximum power output available from the output terminals of said power conditioning means is limited to a magnitude that is regarded by said authoritative entity as being substantially non-hazardous from a fire initiation viewpoint.

18. The lighting system of claim 16 wherein the maximum power output available from said set of distribution conductors in substantially higher than 250 Volt-Ampere, while the maximum power output available from the output terminals of said power conditioning means is on the order of 250 Volt-Ampere or less.

19. The lighting system of claim 16 wherein the electrical output characteristics of said power conditioning means conform to the specifications for Class-3 circuits as defined in Article 725 of the 1984 National Electrical Code.

20. A lighting system for a suspended ceiling, said lighting system being adapted to be powered from the relatively low frequency voltage on an ordinary electric utility power line, said suspended ceiling having a grid-structure and being suspended some distance underneath a permanent ceiling, said lighting system comprising:

frequency conversion means connected with said power line and operable to provide a substantially non-current-limited relatively high frequency output at a set of distribution conductors;

a plurality of lighting fixtures non-permanently mounted at different locations in said grid structure, each lighting fixture: (a) having a set of input terminals, (b) having lamp means, (c) having connect and matching means operative to connect between the input terminals and the lamp means, and to match electric power provided at the input terminals to the electrical requirements of the lamp means, and (d) requiring for proper operation that a relatively high frequency voltage be provided at its input terminals; and for each lighting fixture:

(i) power conditioning means that is non-disconnectably connected with said distribution conductors and mounted at said permanent ceiling in a location approximately above and within a relatively short distance from the lighting fixture, said power conditioning means being operable to provide at a set of output terminals the relatively high frequency voltage required by said lighting fixture, and (ii) flexible cord means operable to provide disconnectable electrical connection between the input terminals of said lighting fixture and the output terminals of said power conditioning means;

whereby each lighting fixture is disconnectably connectable with the output terminals of one of the power conditioning means and operable to be properly powered by the high frequency voltage provided therefrom.

* * * * *

Disclaimer 4,651,059.—*Ole K. Nilssen*, Barrington, Ill. HIGH-FREQUENCY POWER-LIMITED LIGHTING SYSTEM. Patent dated Mar. 17, 1987. Disclaimer filed Feb. 2, 1990, by the inventor.

The term of this patent subsequent to December 2, 2003, has been disclaimed.

[ *Official Gazette April 24, 1990* ]